United States Patent [19]

Pächer et al.

[11] Patent Number: 4,894,813

[45] Date of Patent: Jan. 16, 1990

[54] ALARM SHUT-OFF DEVICE, WITH A WAKE UP SIGNAL DELIVERING INTEGRATED CIRCUIT AND A RECEIVING AND SIGNAL SHAPING NETWORK

[75] Inventors: Lothar Pächer, Mainz; Heinz Schiebelhuth, Frankfurt, both of Fed. Rep. of Germany

[73] Assignee: Braun Aktiengesellschaft, Kronberg, Fed. Rep. of Germany

[21] Appl. No.: 199,155

[22] Filed: May 26, 1988

[30] Foreign Application Priority Data

Jun. 6, 1987 [DE] Fed. Rep. of Germany ..... 3719087

[51] Int. Cl.[4] ..... G04C 21/16

[52] U.S. Cl. ..... 368/256; 368/72; 368/73

[58] Field of Search ..... 368/72, 73, 243–266

[56] References Cited

U.S. PATENT DOCUMENTS

| | | | |
|---|---|---|---|
| 3,498,047 | 3/1970 | McLeod | 368/262 |
| 4,468,131 | 8/1984 | Bul et al. | 368/69 |
| 4,764,910 | 8/1988 | Ichikawa | 368/69 |

*Primary Examiner*—Bernard Roskoski

[57] ABSTRACT

The invention is directed to an alarm shut-off device for an alarm clock or timer permitting a signal delivered by the clock to be interrupted or to be cancelled in that the user of the clock approaches the clock or merely moves a part of his body, for example, his hand, towards the clock. Preferably, the clock is equipped with a transmitter 2, 2' emitting infrared radiation or ultrasonic waves and a corresponding receiver 3, 3' which detects the infrared radiation or the ultrasonic waves reflected by the moved body part 1. A signal shaping network 4, 5 and 6 determines the variation of the intensity with time, which variation is compared in a threshold switching stage 7 with a predeterminable value which, when exceeded, causes the alarm signal A to be shut off.

20 Claims, 6 Drawing Sheets

05330

05330

05330
FIG.3
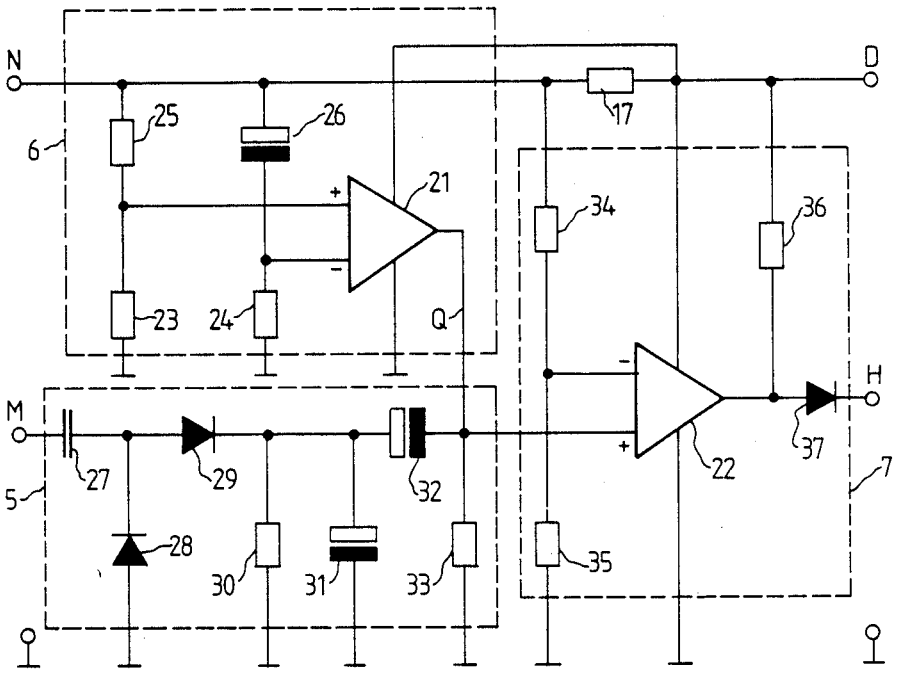
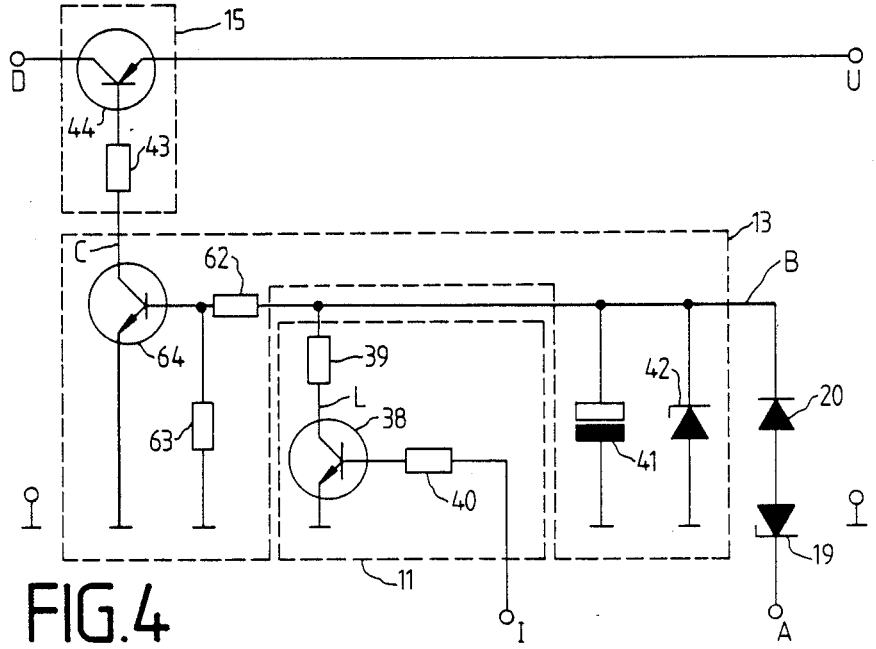
FIG.4

05330

05330

05330

ALARM SHUT-OFF DEVICE, WITH A WAKE UP SIGNAL DELIVERING INTEGRATED CIRCUIT AND A RECEIVING AND SIGNAL SHAPING NETWORK

This invention relates to an alarm shut-off device, in particular for alarm clocks or timers.

Conventionally, the alarm devices contained in alarm clocks or timers which issue an acoustic alarm signal are turned off by the user of the clock by a movable control element to be operated by hand, for example, a key or a rocker. Thus, for example, German Utility Pat. DE-GM 78 27 708 discloses an alarm clock in which on the upper side of the housing a rocker switch is provided extending almost over its entire width.

From German Utility Pat. DE-GM 83 12 662 an alarm clock is already known wherein the control device for interrupting the alarm signal is no longer a movable control element but includes just two sensors which, when touched simultaneously, for example by the tip of a finger, cause the alarm signal to be interrupted. In this arrangement, the touch-responsive sensors may be simple metal wires or -as described in DE-GM 83 12 662 they may be merely a conductive enamel coating applied to the housing. However, also in this arrangement the least the user is required to do if he wishes to interrupt the alarm signal is to touch the alarm clock.

In the battery-operated alarm device described in German Pat. DE-PS 34 04 252, the user of the clock may interrupt or cancel the alarm signal by an acoustic signal provided by the human voice, thereby eliminating the need for touching the alarm device. In this alarm device, the acoustic signal formed by the human voice is received by a receiving and signal shaping network comprising a microphone, a filter and amplifier unit and a rectifier, the output thereof being applied to the input of a one-shot multivibrator changing to an astable state in the presence of a corresponding signal level. This change then effects a change in the signal at an input of an integrated clock circuit, causing this circuit to stop delivering the drive signal for an alarm signal converter. Therefore, to save current, both the microphone and the filter and amplifier unit are not connected to their voltage supply until after commencement of delivery of the alarm signal.

This alarm device has the disadvantage that, in spite of the addition of a high-pass and a low-pass filter to the circuitry, whereby practically only frequencies in the range of 1,000 Hz (range of the fundamental tone of the human voice) are amplified, background noise caused by various sources of sound may shut off the wake-up signal before the sleeper was waked up.

Another disadvantage of this alarm device is that the acoustic signal given by the user of the clock may inadvertently awaken any other persons present.

From DE-OS 30 40 751 a non-contact switch is known operating with an infrared transmitting and receiving device. However, the known transmitting and receiving device configured as a reflection light barrier is not suitable for use as an alarm shut-off device for a clock, because numerous objects as a pillow or the sleeper him or herself lie particularly in the range of action of an alarm shut-off device of this type, which may cause the device to turn itself off automatically. Using this known non-contact switch for an alarm clock or timer would thus require the removal of all objects appreciably reflecting infrared radiation from the range of action of the transmitting and receiving device, or a suitable placement of the clock.

It is, therefore, an object of the present invention to provide an alarm shut-off device for an alarm clock or timer which is not to be operated by hand, which provides interference-proof operation while maintaining a low power consumption, is fully adequate for use without the need to choose a particular placement, and which prevents any further persons present in the room from being inadvertently waked up or disturbed by the measures necessary for turning the alarm signal off.

This object of the invention is accomplished in an alarm clock according to the preamble of patent claim 1 by the features continued in the characterizing part thereof.

According to the invention, the receiving and signal shaping network of the alarm shut-off device is thus configured as an infrared motion detector. Via a receiver, this detector may, for example, detect the thermal radiation emitted by the user's hand,, or it may be configured as a transmitting and receiving device in which a transmitter sending on a predetermined frequency is provided, its infrared radiation being reflected, for example, by the user's hand. If a transmitter is provided, the alarm shut-off device operates as a reflection motion detector. In accordance with the invention, the alarm shut-off device responds only to a motion within the range of reception and includes, in addition to a filter amplifier and a threshold switching stage, also a rectifier and differentiator stage.

In the alarm shut-off device of the invention, it is also possible to substitute an ultrasonic transmitter and receiver for an infrared receiver or for an infrared receiver plus transmitter. In addition to evaluating the intensity change of the reflected ultrasonic waves, an ultrasonic receiver also permits the evaluation of a Doppler shift occurring between the transmitted and the received signal, because, in contrast to the infrared radiation range, in the ultrasonic wave range the frequency shift occurring as a result of moved body parts is no longer negligibly small.

Preferably, the differentiator stage has a signal delay stage connected subsequent to or parallel with its output. The signal delay stage serves the purpose of preventing that the person to be waked, on the sound of the alarm signal, interrupts its further sounding already by uncontrolled movements made while still half asleep. The duration of the delay is therefore chosen such that the wake-up signal given is of a length of time sufficient to ensure that the person to be waked becomes roused from sleep. Accordingly, the alarm shut-off device does not reach its full readiness for service until after a predetermined time lag.

Because the signal delay stage is arranged separately from the filter amplifier, the dynamic range of the filter amplifier can be increased by an advantageous dimensional design of the rectifier and differentiator stage to such an extent as to eliminate the need for an additional automatic gain control. In spite of the time-constant reflection signal originating from non-moving objects, suitable tests have shown that with this improvement of the invention the filter amplifier is driven to saturation by non-moving objects only in the very rarest of cases. By contrast, arranging a signal delay device within the filter amplifier would necessitate a complex gain control.

Further advantageous embodiments of the alarm shut-off device of the invention will become apparent from the subclaims.

Embodiments of the invention will be explained in more detail in the following with reference to the accompanying drawings. In the drawings, FIG. 1 is a block diagram showing an embodiment of an alarm shut-off device of the invention;

FIG. 3 is a schematic showing embodiments of a rectifier/differentiator stage, a signal delay stage and a threshold switching stage of FIG. 1;

FIG. 4 is a schematic showing embodiments of a switching stage, an ON-OFF control stage and a turn-off element of FIG. 1;

Figure 1:
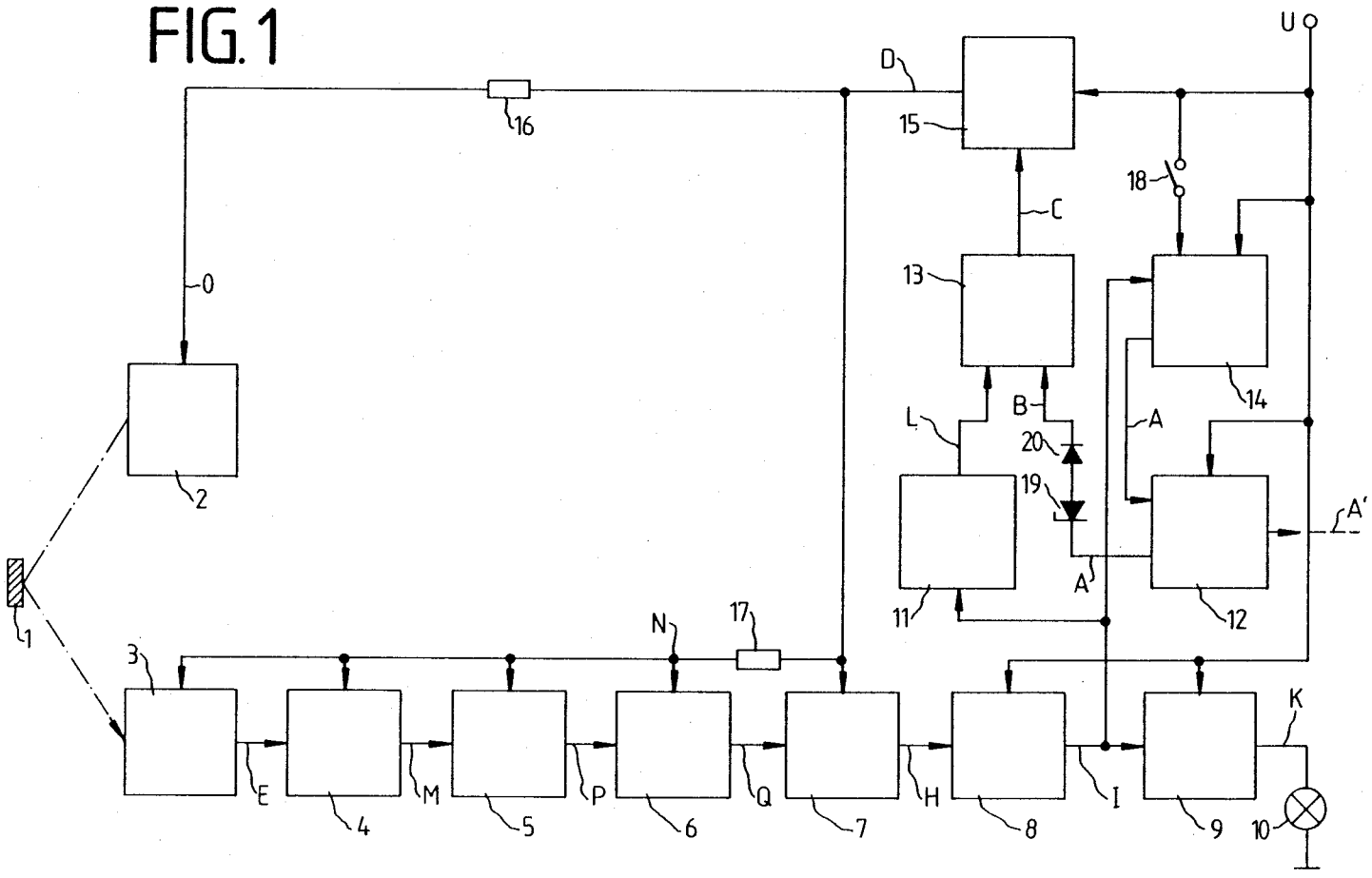
Figure 2:
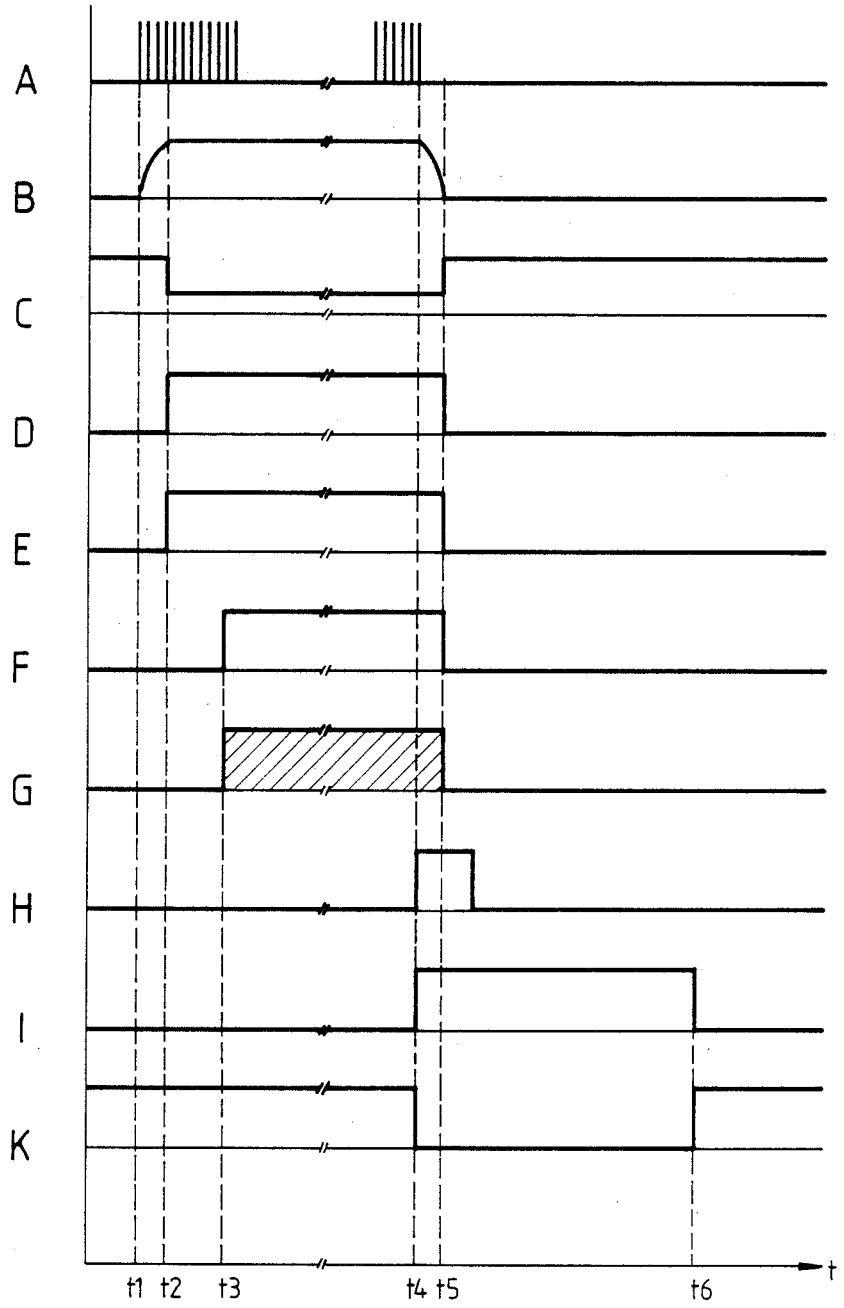
FIG. 2 is a graphical representation of pulses explaining the mode of operation of the alarm shut-off device of FIG. 1.

FIG. 1 shows a block diagram of a timer or alarm clock which is equipped with an alarm shut-off device of the invention. The assemblies illustrated in FIG. 1 have in part the same function as the alarm shut-off device known from German Pat. DE-PS 34 04 252. However, the alarm shut-off device of the invention operates as a motion detector and not as a voice-sensitive switching device. The mode of operation of the alarm shut-off device will be described in the following in connection with the pulse diagram shown in FIG. 2.

Reference numeral 1 identifies a non-stationary reflector for infrared radiation emitted from a transmitter 2, for example the moving hand of a person having been waked up. The full battery voltage resides at terminal U. From terminal U, the battery voltage is applied to a clockwork 14, a signal generator 12, a lamp driver 9 and a one-shot multivibrator 9. Although the battery voltage is applied to all assemblies 8, 9, 12, 14, only the clockwork 14 is in an active state, accordingly drawing battery current. When a manually operable switch 18 is closed, an automatic wake-up device contained in the circuit of the clockwork 14 is in a ready position. When the time kept in the clockwork 14 reaches the set wake-up time, a second switch provided therein (not shown) is closed, this switch being connected in series with switch 18. Closing of the second switch (time *t*1 in FIG. 2) enables in the clockwork 14 an integrated circuit, not shown either, which supplies a wake-up signal A to the signal generator 12. The signal generator 12 converts the wake-up signal A into an acoustic signal A' supposed to awake the sleeping person. The wake-up signal A or the acoustic signal A' consists of a short pulse train made up of individual pulses whose frequency lies in the audible range. Following a short interval, the first pulse train is followed by a second pulse train. The pulse trains continue to be delivered until the wakened person trips the alarm shut-off device or until the integrated circuit interrupts the wake-up signal itself by turning it off automatically after, for example, 128seconds.

To activate the alarm shut-off device, the wake-up signal A is passed via a Zener diode 19 and a diode 20 to an ON-OFF control stage 13 the circuit diagram of which is shown in FIG. 4. By means of a further Zener diode 42 and a charging capacitor 41, the control stage 13 produces an ON signal which is at "zero" value at time t1 corresponding to the charging characteristic of capacitor 41, reaching its maximum voltage value until time t2. The voltage value attained at time t2 causes transistor 64 (see FIG. 4) to conduct (output signal C). Transistor 38 which is associated with a turn-off element 11 is still nonconducting and will not be enabled until at a later time t4, as described in the following.

Output signal C which is delivered to a series transistor 44 of a switching stage 15 via a resistor 43 causes series transistor 44 to apply the battery voltage U at time t2. In consequence, the assemblies 2, 3, 4, 5, 6 and 7 do not receive signal D (applied battery voltage U) until time t2. From this time on, transmitter 2 therefore issues transmitter pulses which, for example, are reflected by the pillow or the sleeping person itself and are detected by a receiver 3 (output signal E). The detected signal E passes via a filter amplifier, whose pass band is adjusted to the transmitter pulse recurrence frequency, to a rectifier and differentiator stage 5 as signal M. In the rectifier stage, the AC voltage transmitter signal is converted to a DC voltage equally increasing as the intensity increases.

In FIG. 3, the rectifier and differentiator stage 5 is shown together with a signal delay stage 6 and a threshold switching stage 7. Signal M is passed via a capacitor 27 to two diodes 28, 29. The two diodes 28, 29 cooperate with capacitors 27, 31 to form a voltage-doubling circuit rectifying signal M. The rectified signal M charges a capacitor 31 capable of discharging again via a parallel resistor 30. Connected subsequent to the rectifier is a differentiator comprised of capacitor 32 and resistor 33. The differentiator causes the alarm shut-off device to respond to the variation with time of the signal E received, and not to the intensity of this signal. This means that signal P at the output of the rectifier and differentiator stage 5 is a function of the speed of motion of the reflector 1, and the cutoff frequency of the differentiatior 32, 33 determines the minimum approaching speed of the reflector 1 in the direction of the clock in which the transmitting and receiving device is received.

By adjusting the components of the filter amplifier 4 and the rectifier and differentiator stage 5 as disclosed in the invention, an expansion of the dynamic range can be accomplished in the amplification of signal E and signal P derived therefrom. As a result of the large dynamic range, the possible presence of a static reflector causes only in the rarest of cases an input voltage at the amplifier input driving the amplifier to saturation. Therefore, an automatic gain control is not necessary.

To explain the reason for the advantageous expansion of the dynamic range, the quantities set forth below are introduced in the following:

$U_e$: Input Pulse Amplitude of Filter Amplifier 4 (Signal E)

$U_a$: Output Pulse Amplitude of Filter Amplifier 4 (Signal M)

T: Output Pulse Duration of Signal M $T_a$: Charging Time Constant of Capacitor 31 (FIG. 3)
$T_e$: Discharging Time Constant of Capacitor 31
$T_o$: Pulse Repetition Interval of Transmitter 2
N: Number of Transmitter Pulses of Transmitter 2
$U_c$: Rectifier Voltage at Capacitor 31

The time-dependent instantaneous value $U_c(t)$ follows the function:

$$U_c(t)=U_a\times(1-\exp T\times N(t)/T_a)$$

If $T_a$, $T_e << T_o$, the arithmetic mean $>U_c<$ of the rectifier voltage $U_c$ results as follows in the steady state:

$$<U_c>=U_a\times T/T_o$$

From this it results that $<U_c>$ may still increase even if limiting of the output pulse amplitude $U_a$ (saturation of the filter amplifier 4) has already occurred, this increase being due to an increase in the output pulse duration T. Such an increase in the output pulse duration T is the case here because the filter amplifier 4 has a differentiating effect as a result of which the output pulse duration increases with an increase in the input pulse amplitude. This increase occurs even when the filter amplifier 4 is already fully saturated preventing any further increase in the output pulse amplitude $U_a$.

The pulse of signal P which is derived from signal E could be used without time delay to interrupt the sending of the acoustic wake-up signal A' which is issued as early as from time t1. The invention, however, provides for two reasons a signal delay for signal P as a result of which a predetermined dead time has to elapse before pulses of signal P cause the wake-up signal A to be turned off.

For one thing, the wake-up signal may cause a sleeping person to move, for example, to turn around in the bed while passing from the state of sleep to the state of being awake. Such a movement might turn off the alarm shut-off device before the person is sufficiently awake. In consequence, no further tone alarm would sound, and the person to be waked up would fall back to sleep.

For another thing, it is to be considered that on application of the battery voltage D at time t1 the capacitor 31 (see FIG. 3) is uncharged. The charging current surge occurring at the beginning of the charging operation would suffice to produce at differentiator 32, 33 —equivalent to signal P — a pulse actuating the alarm shut-off device and interrupting the issue of the wake-up signal A. To prevent this from occurring, the signal delay stage 6 is provided which supplies a dead time sufficient to permit capacitor 31 to charge and a minimum number of wake-up pulse trains to be issued awakening the sleeper reliably.

In FIG. 1, the signal delay stage 6 is connected, by way of example, in series with the signal processing chain comprising the assemblies 3, 4, 5, 7, 8. In accordance with FIG. 2, the signal delay stage 6 is not enabled until time t3 (signal F). The delay or dead time is thus obtained from t3−t2. Equally, the threshold switching stage 7 connected subsequent to the signal delay stage 6 cannot further process incoming interrupt signals for the wake-up signal A until time t3. In terms of time, the active operating range of the alarm shut-off device is thus after signal G from time t3 on.

If the person meanwhile awakened by the wake-up signal A wishes to interrupt the issue of further wake-up signals A, it only has to move its hand acting as reflector 1 briefly into the range of action of the transmitter pulses emitted by transmitter 2. Reaching to the clock and operating the switch 18 is not necessary because the field of radiation of the transmitter pulses extends as far as to the person in bed. The movement of reflector 1 produces at time t4 a short pulse H at the output of the threshold switching stage 7. Provision of the threshold switching stage 7 is necessary to permit a specific received signal value to be determined from which the wake-up signal A is interrupted. The output pulse H of the threshold switching stage 7 is passed to a one-shot multivibrator 8 switching to its astable state at time t4. Switching of the one-shot multivibrator 8 interrupts the delivery of the wake-up signal A because the output signal I of the one-shot multivibrator 8, in addition to being applied to the assemblies 9 and 11, is also passed to the integrated circuit in clockwork 14 which interrupts delivery of the driving pulses for producing the acoustic signal A'in signal generator 12. A lamp 10 which illuminates the clockface is turned on via the lamp driver 9 (output signal K). The lamp 10 turns on at time t4 simultaneously with the switching of the one-shot multivibrator 8. The lamp 10 turns itself off again when the one-shot multivibrator 8 returns to its stable state at time t6. The period of time during which the lamp is on is thus determined by the duration of the astable state of the one-shot multivibrator 8 which lasts from t4 to t6.

As shown in FIGS. 1 and 4, signal I is further applied to turn-off element 11. Turn-off element 11 is made up of a transistor 38, a base resistor 40 and a collector resistor 39. The common-emitter transistor 38 is connected in the base-emitter circuit of transistor 64 of the ON-OFF control stage 13. The leading edge of signal I at time t4 causes transistor 38 to conduct. As transistor 38 becomes conducting, a capacitor 41 discharges through collector resistor 39. At time t5, the voltage value of signal B has dropped to a low value, causing transistor 64 and consequently at the same time transistor 44 to be off. At time t5, the battery voltage D is thereby disconnected from assemblies 2, 3, 4, 5, 6 7. This means that the switching stage 15 is turned on via signal B (time t2) and turned off at time t5 via signal L which is derived from signal I. Accordingly, the alarm shut-off device is in an idle state, being activated again with the switch 18 closed in the manner described above by applying the battery voltage D, its full operating condition being attained not until after the delay or dead time t3—t2 has elapsed. Until opening of the switch 18, the integrated circuit in the clockwork 14 executes another wake-up cycle (snooze) after a few minutes by delivering the wake-up signal A. In the known manner, the alarm shut-off device is not cancelled until the switch 18 is opened.

FIG. 3 shows, in addition to the rectifier and differentiator stage 5, an embodiment of the signal delay stage 6 and the threshold switching stage 7, the most important component of each stage being a comparator 21 and 22, respectively. The operating voltage D is applied to the comparators 21, 22. The supply voltage N applied to the filter amplifier 4 is smoothed by resistor 17 and a capacitor (not shown) contained in the filter amplifier 4.

The signal delay stage 6 operates in such a manner that the voltage of the voltage divider comprised of resistors 25, 23 is applied to the positive input of comparator 21. The negative input of comparator 21 is connected to a divider formed of a capacitor 26 and a resistor 24 connected in series. Capacitor 26 is connected to voltage N and resistor 24 is connected to ground. The negative input is connected to the mid-connection of capacitor 26 and resistor 24. When voltage N is applied at time t2, the negative input is more positive than the positive input. The output of comparator 21 is thus at zero potential, causing unwanted pulses of signal M to be short-circuited to ground via capacitor 32. After the delay or dead time t3 −t2 has elapsed, capacitor 26 has been charged via resistor 24 such that the negative input is then more negative than the positive input. This causes the comparator ouput to turn off, and the output Q becomes high resistance or ineffective because an operational amplifier (LM 393) having an open-collector output is involved. The time-determining element which determines the delay or dead time is formed of the series connection of capacitor 26 and resistor 24. The switch point depends also on the magnitude of the voltage value set at resistor 23. In contrast to FIG. 1 in which the signal delay stage 6 is series-connected in the transmission chain, the delay stage 6 of FIG. 3 is configured as being in parallel with the rectifier and differentiator stage 5 which is the reason why it is turned on during the delay time and subsequently inactive.

The threshold switching stage 7 is comprised of resistors 34 and 35 forming a voltage divider and having its tap connected to the negative input of comparator 22. The positive input of comparator 22 is connected to the output of differentiator 32, 33 and to the output Q of comparator 21. Comparator 22 has its output connected to a diode 37 which is connected to the input of one-shot multivibrator 8, as well as to a resistor 36 which is connected to battery voltage D. If the voltage surge supplied via capacitor 32 exceeds the reference voltage formed by voltage divider 34, 35, the comparator output switches from zero to battery voltage D. This output pulse at comparator 22 changes the state of the one-shot multivibrator 8 at time t4 via the diode 37.

Figure 5:
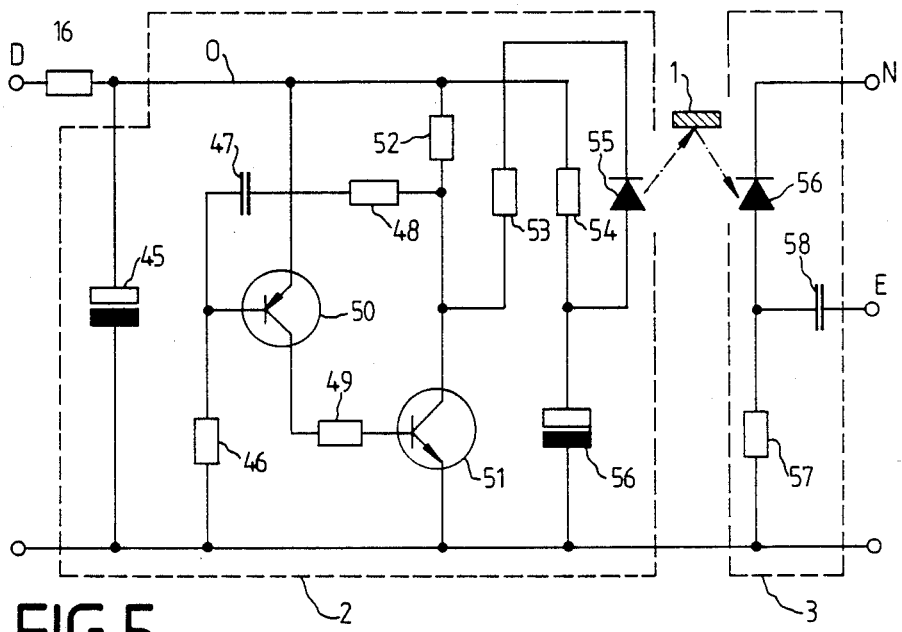
FIG. 5 is a schematic showing embodiments of a transmitting and receiving stage of FIG. 1.

FIG. 5 shows an embodiment of the transmitter 2 and the receiver 3. The transmitter 2 receives via a resistor 16 the voltage D and the input signal 0. In cooperation with a capacitor 45, the resistor 16 decouples the transmitter 2 from the receiver 3 to prevent the occurrence of operating voltage fluctuations of the shape of transmitter pulses in the receiver 3. The transmitter 2 further includes two complementary transistors 50, 51 which combine with resistors 46, 48, 49, 52 and a capacitor 47 to form an astable multivibrator. The pulse recurrence frequency is determined by capacitor 47 and resistor 46. The pulse duration results from the dimensional design of capacitor 47 and resistor 48. As transmitting element, an infrared diode 55 is used having its anode connected to the junction of a resistor 54 and a charging capacitor 56. The diode has its cathode connected to the collector of transistor 51 via a resistor 53. In the off state of transistor 51, capacitor 56 is charged via resistor 54, discharging via diode 55 when transistor 51 becomes conducting. Resistor 53 limits the diode current. The pulse control mode reduces the load on the battery since battery capacity is limited. The pulse recurrence frequency is preferably 500 Hz.

The infrared radiation emitted by the diode 55 is reflected by reflector 1 and reaches the receiving element, which is an infrared-sensitive diode 56 having its cathode connected to the battery voltage N. Diode 56 combines with a resistor 57 to form a voltage divider having connected to its junction a capacitor 58 feeding the transmitter pulses received from the diode and converted to current pulses to the filter amplifier 4.

Figure 6:
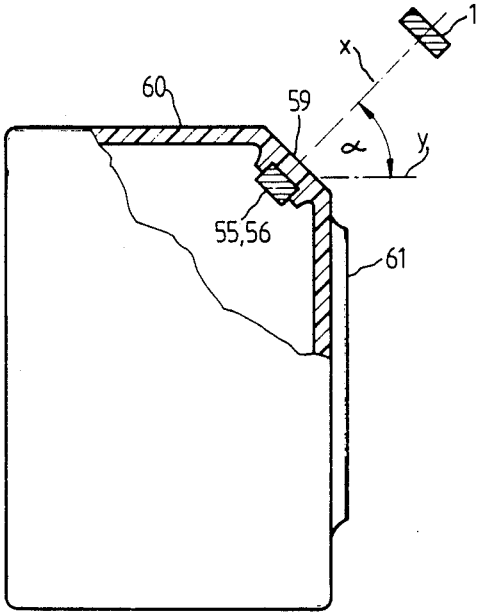
FIG. 6 is a view of a housing section of a clock equipped with an alarm shut-off device of the invention.

In FIG. 6, a side view of a clock housing 60 partially broken away is shown with its clockface 61. The receiving and transmitting elements 55, 56 are preferably relatively spaced on the upper edge of the front side of the clock housing 60. In the wall of the housing 60, entry and exit openings 59 for the signals transmitted and received are provided, their number depending on the number of transmitting and receiving elements 55, 56. The main transmitting direction X (or receiving direction) which is determined by the radiation characteristic of the receiving and transmitting element may be upwardly or downwardly inclined relative to the horizontal Y depending on the application. The main transmitting direction is preferably inclined upwardly at an angle of between 20° and 25°.

Choosing a main transmitting direction which is not vertical to the clockface 61 provides, in addition to the operating point of the threshold switching stage 7 which is determined by the dimensional design of the capacitor 31 and the resistor 30, another possibility of adapting the sensitivity of the alarm shut-off device to the requirements of practice. The inclination of the main transmitting direction X by 20° to 25° in upward direction serves to blank out static reflectors such as a lamp, books or the like, which might be located immediately in front of the clock, as largely as possible. It is to be understood that, in addition to this, the sensitivity of the alarm shut-off device can be further adapted to practical conditions by suitably dimensioning the filter amplifier 4.

Whilst the alarm shut-off device of the invention has so far been described only with reference to embodiments incorporating an infrared transmitter and receiver which evaluates the intensity variation of the received signal, which variation is caused by the movement of the reflector 1, a transmitter emitting infrared radiation may be dispensed with if the receiver diode 55 is replaced by a passive infrared detector of a sensitivity such as to be capable of detecting the thermal radiation issued by the user of the clock himself.

Further, the invention is not only limited to embodiments operating with a filter amplifier. Rather, frequency discriminators or sample and hold circuits may be provided in the signal chain from the receiver 3 to the one-shot multivibrator 8. Still further, the invention may be construed such as to respond not only to an approaching movement but also to a movement of the reflector away from the clock.

Figure 7:
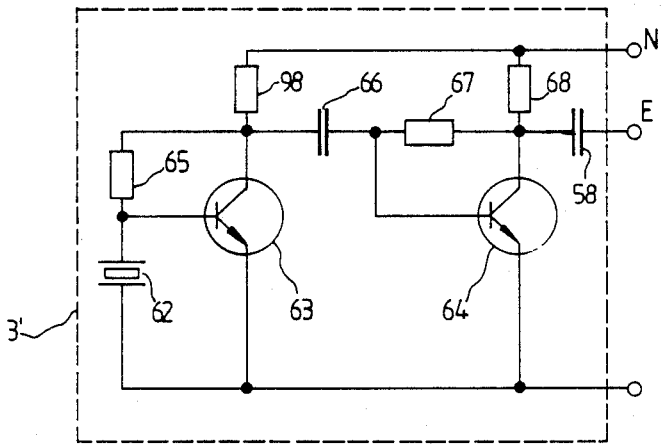
FIG. 7 is a schematic showing an embodiment of an ultrasonic receiver for use in the alarm shut-off device of the invention.

FIG. 7 shows an embodiment of an alarm shut-off device using, in lieu of an infrared-sensitive receiver, an ultrasonic receiver 3'which is coupled to the filter amplifier 4 via a capacitor 58. With regard to the mode of operation of the assemblies connected subsequent to the ultrasonic receiver 3', the corresponding part of the description of FIGS. 1 to 6 applies equally, so that the mode of operation of these assemblies will not be explained further. Important parts of the ultrasonic receiver 3' and two npn transistors 63, 64 whose operating points are adjusted by means of resistors 65, 67, 68 and 98. To receive ultrasonic waves, an ultrasonic transducer 62 is used, for example, a piezoceramic transducer, which is connected in series with resistor 65. In conjunction with resistor 98, resistor 65 determines the operating point for transistor 63, while the ultrasonic transducer 62 in the base-emitter branch of transistor 63 serves as signal source for the filter amplifier. The signals delivered by an ultrasonic transmitter are detected by the ultrasonic transducer 62 and converted to voltage variations which are amplified as AC voltage signals and applied, via a capacitor 66, to the subsequent transistor 64. At the output end, the amplified signal is tapped at the collector of transistor 64 to be further processed in the subsequent assemblies in the manner previously described.

Figure 8:
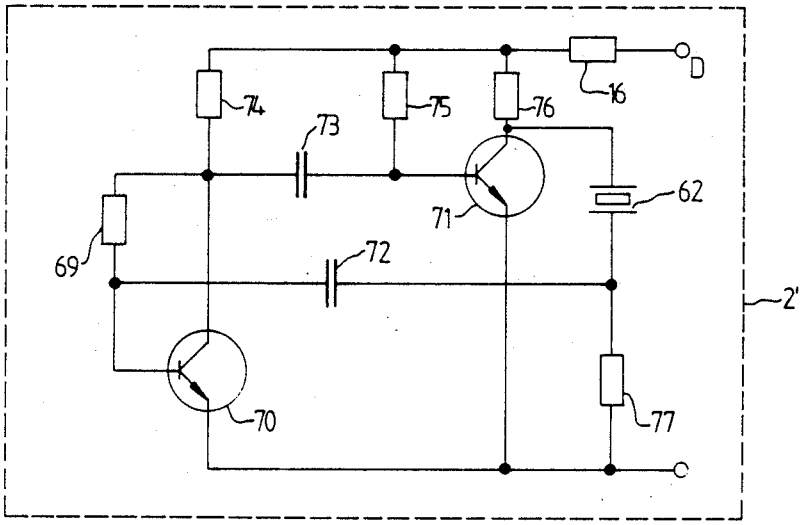
FIG. 8 is a schematic showing an embodiment of an ultrasonic transmitter acting in cooperative relation with the ultrasonic receiver of FIG. 7.

FIG. 8 shows an embodiment of an ultrasonic transmitter 2'which in its capacity as an astable multivibrator delivers pulses preferably of a frequency of between 30 and 40 KHz which are detected by the receiver 3' illustrated in FIG. 7. In this arrangement, the ultrasonic transducer 62 is connected across a series resistor 77 in the collector branch of a transistor 71. Unlike FIG. 7, the ultrasonic transducer 62 of FIG. 8 converts voltage variations at the collector of transistor 71 into ultrasonic vibrations which, as described in the foregoing, are converted back into voltage variations by the receiver 3'. Essential parts of the ultrasonic transmitter 2' are two npn transistors 70, 71, with two capacitors 72, 73 serving as feedback elements in the generation of the vibrations. Resistors 69, 74, 75, 76 in turn serve to adjust the operating points of the two transistors 70 and 71.

Figure 9:
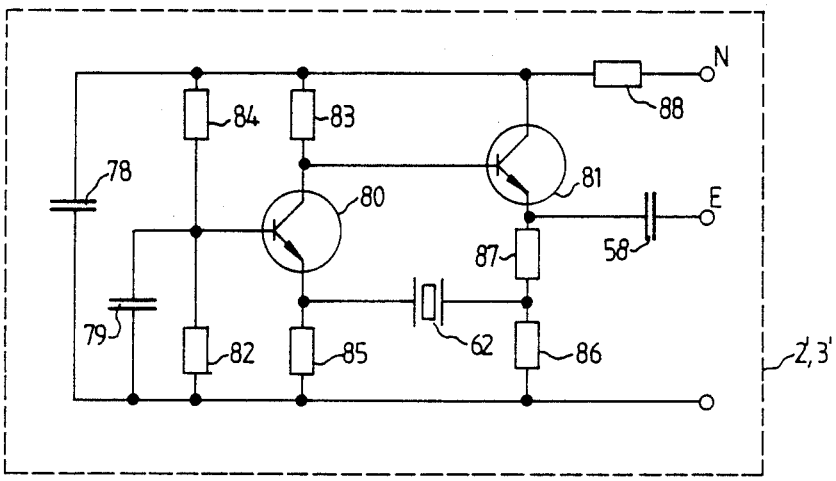
FIG. 9 is a schematic showing a first embodiment of an assembly operating as ultrasonic receiver and transmitter simultaneously.

FIG. 9 shows an embodiment in which —unlike those of FIGS. 7 and 8 —transmitter and receiver are combined to a single assembly, that is, the assembly shown in FIG. 9 operates as both transmitter and receiver. In this embodiment, the two transistors 80, 81 are connected to form an emitter-coupled astable multivibrator, with the two emitters being coupled through the ultrasonic transducer 62 shifting, at resonance, the phase by an angle of 180°. Resistor 87 serves to decouple the output signal from the vibration pulses. Capacitor 78 combines with resistor 88 to form a filtering unit for decoupling the supply voltage from the vibration pulses. Again, resistors 82, 84, 83 and 85 serve the function of adjusting the operating points of transistors 80, 81, while the feedback coefficient is adjusted by means of the voltage divider comprised of resistors 86 and 87. Since transistor 80 operates as a common-base transistor, the base is short-circuited to "zero" through capacitor 79 for decoupling purposes between the input and the output signal.

When the acoustic waves emitted by the ultrasonic transducer 62 are reflected, they return to the transducer where they are converted again to voltage pulses. That is, the acoustic waves produced become superposed with the reflected acoustic waves, with two processes occurring within the ultrasonic transducer 62 simultaneously, i.e., the conversion of voltage values into transmitted acoustic waves and, conversely, the conversion of reflected acoustic waves into voltage values. This is possible because the ultrasonic transducer is capable of operating reversibly. Accordingly, the voltage values at the emitter of transistor 81 are superposed also, with the subsequent stages evaluating only the variation of the reflection of the ultrasonic waves by a moved object as, for example, a hand, as described previously. If ultrasonic waves are reflected by stationary and moving objects at the same time, beats will result due to the Doppler effect the frequency of which is dependent on the speed of motion.

Figure 10:
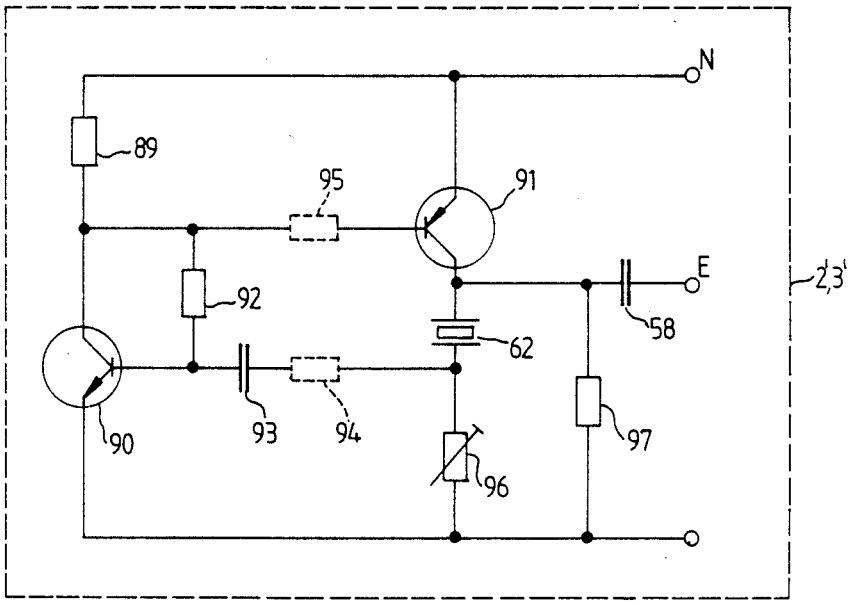
FIG. 10 is a schematic showing a second embodiment of an assembly operating as ultrasonic receiver and transmitter simultaneously.

FIG. 10 shows a second embodiment of an assembly operating as a receiver and a transmitter simultaneously. The essential part of the circuitry of FIG. 10 is an npn/pnp transistor pair 90, 91 in complementary connection. A capacitor 93 is provided as feedback element. The ultrasonic transducer 62 is connected in series with a potentiometer 96 in the emitter branch of transistor 91. To maintain the flow of emitter current, an emitter resistor 97 is connected in parallel with the series circuitry comprising resistor 96 and transducer 62 which permits only a flow of AC current due to the capacitive effect of the transducer 62. Potentiometer 96 permits adjustment of the voltage level of the feedback pulses which are fed to transistor 90 via capacitor 93. Resistors 89, 92, 94, 95 serve again the function of adjusting the operating points, with resistors 94, 95 (shown in dashed lines) being dispensable in certain applications.

We claim:

1. An alarm shut-off device, in particular for an alarm clock or timer, with a clockwork containing an integrated circuit which, when the clock time matches the alarm time, delivers a wake-up signal to a signal generator preferably configured as an electroacoustic transducer, with a receiving and signal shaping network which includes a receiver sensitive to radiation a filter amplifier, and a threshold switching stage for receiving and further processing a shut-off signal issued by the user of the clock, means responsive to said wake-up signal for connecting said receiving and signal shaping network to its voltage supply following which said receiving and signal shaping network processes said shut-off signal such that its application to an input of said integrated circuit causes said circuit to interrupt the delivery of said wake-up signal, said receiving and signal shaping network further including a rectifier and differentiator stage, said rectifier and differentiator stage including rectifier circuitry and a differentiator connected subsequent to said rectifier circuitry, the output signal of said differentiator being determined by the variation with time of the radiation detected by said receiver.

2. An alarm shut-off device as claimed in claim 1 wherein said device includes a radiation emitting transmitter, the radiation emitted by said transmitter being reflected by the user of the device and detached by said receiver.

3. An alarm shut-off device as claimed in claim 1 wherein between the output of said threshold switching stage and the input of said integrated circuit a one-shot multivibrator is connected the output of multivibrator being connected to the input of said integrated circuit and said multivibrator being caused to assume its astable state when an ouput signal (H) occurs at the output of said threshold switching stage which is connected to the input of said multivibrator.

4. An alarm shut-off device as claimed in claim 3 wherein said rectifier and differentiator stage includes two series-connected assemblies of which the assembly acting as a rectifier is comprised of a voltage-doubling circuit including two diodes and two capacitors, while the assembly acting as a differentiator is comprised of a capacitor and a resistor connected to series.

5. An alarm shut-off device as claimed in claim 4 wherein said receiving and signal shaping network includes a signal delay stage arranged ahead of said threshold switching stage and serving to delay, following delivery of said wake up signal (A), its output signal (Q) relative to its input signal (P) for such a length of time (t3−t2) that the said signal generator issues an alarm signal (a) at least for a predeterminable time span (t3−t1).

6. An alarm shut-off device as claimed in claim 5 wherein said signal delay stage is connected in parallel with said rectifier and differentiator stage and includes an open-collector comparator, the output of which is connected to the output of the differentiator of said differentiator stage, and that the delay time (t3−t2) is determined by a capacitor and a resistor connected in series.

7. An alarm shut-off device as claimed in claim 6 wherein said threshold switching stage includes an comparator having applied to tis first input a reference voltage, its second input being connected both to the output (P) of said differentiator of said rectifier and differentiator stage and to the output (Q) of said comparator of said signal delay stage.

8. An alarm shut-off device as claimed in claim 3 wherein the wake-up signal (A), in addition to being applied to said signal generator, is further applied to a first input (B) of an ON-OFF control stage via a Zener diode and a diode connected in series, said control stage connecting, via a switching stage, both said receiving and signal shaping network and said transmitter to their respective supply voltages.

9. An alarm shut-off device as claimed in claim 8 wherein said ON-OFF control stage produces an ON signal from signal (B) present at the output of said diode by means of a Zener diode and a charging capacitor in parallel arrangement, said ON signal rendering an output transistor conducting with a predetermined time delay (t2−t1), said output transistor in turn causing a series transistor arranged in said switching stage to conduct.

10. An alarm shut-off device as claimed in claim 8 wherein the output signal (I) of said one-shot multivibrator is further applied through a turn-off element to a second input (L) of said ON-OFF control stage the ouput signal (C) of which disconnects said receiving and signal shaping network and said transmitter from their respective supply voltages via said switching stage after said one-shot multivibrator has switched to its astable state.

11. An alarm shut-off device as claimed in claim 10 wherein said turn-off element is comprised of a common-emitter transistor arranged in the base-emitter circuit of the ouput transistor of said ON-OFF control stage and having the output signal (I) of said one-shot multivibrator applied to its base.

12. An alarm shut-off device as claimed in claim 2 wherein said transmitter includes an infrared diode emitting infrared radiation in the pulse control mode, with the pulse recurrence frequency and the pulse duration being determined by the dimensional design of the capacitor and a resistor combining with two further resistors to form an astable multivibrator.

13. An alarm shut-off device as claimed in claim 12 wherein the pulse recurrence frequency of said transmitter is preferably in the range of 500 Hz in infrared operation.

14. An alarm shut-off device as claimed in claim 2 wherein said receiver includes an infraredsensitive diode which has its cathode connected to a voltage (N) derived from the battery voltage (U) and combines with a resistor to form a voltage divider to the tap of which a capacitor is connected supply the signals received from said diode to said filter amplifier.

15. An alarm shut off device as claimed in claim 2 wherein said receiver and said transmitter are relatively spaced on the upper edge of the front side of the clock housing, and that the main transmitting or receiving direction X of said transmitter or receiver signal is inclined upwardly relative to the horizontal Y by an angle of preferably between 20° and 25°.

16. An alarm shut-off device as claimed in claim 3 wherein the output signal (I) of said one-shot multivibrator is further applied to the input of a lamp driver, the output signal (K) of which differs from zero value as long as said one-shot multivibrator is in its astable state.

17. An alarm shut-off device as claimed in claim 2 wherein said receiver and said transmitter operate in the ultrasonic wave range and form a joint transmitting and receiving assembly including an astable multivibrator and receiving assembly including transistors, with an ultrasonic transducer forming a feedback element for generating an oscillatory response.

18. An alarm shut-off device as claimed in claim 17 wherein said ultrasonic transducer is connected via a decoupling resistor arranged in the emitter branch of said two transistors, to the ouput of said transmitting and receiving assembly, said decoupling resistor being connected in series with an emitter resistor.

19. An alarm shut-off device as claimed in claim 2 wherein said receiver and said transmitter operate in the ultrasonic wave range and form a joint transmitting and receiving assembly including as astable multivibrator with two transistors in complementary connection, an ultrasonic transducer is connected, in series with a resistor, in the emitter branch of a transistor at the output end and an emitter resistor is connected in parallel with said serially connected ultrasonic transducer and said resistor.

20. An alarm shut-off device as claimed in claim 19, wherein said resistor is a potentiometer.

* * * * *

UNITED STATES PATENT AND TRADEMARK OFFICE

CERTIFICATE OF CORRECTION

PATENT NO. : 4,894,813

DATED : January 16, 1990

INVENTOR(S) : Lothar Pacher, et al.

It is certified that error appears in the above-identified patent and that said Letters Patent is hereby corrected as shown below:

Col. 1, line 24, insert a space after the dash;
line 25, insert a dash after "662"

Col. 2, line 15, change "continued" to --contained--;
line 21, after "hand" delete the comma.

Col. 5, line 11, "<<" should be -->>--;
line 11, ">$U_C$<" should be --<$U_C$>--

Col. 6, line 17, after "A'" insert a space;

UNITED STATES PATENT AND TRADEMARK OFFICE

CERTIFICATE OF CORRECTION

PATENT NO. : 4,894,813

DATED : January 16, 1990

INVENTOR(S) : Lothar Pacher, et al.

It is certified that error appears in the above-identified patent and that said Letters Patent is hereby corrected as shown below:

Col. 8, line 49, after "3'" insert a space.

Col. 9, line 6, after "2'" insert a space.

Col. 10, claim 5, line 62, "(a)" should be --(A')--.

Col. 11, claim 7, line 5, "an" should be --a--;
claim 7, line 6, "tis" should be --its--;
claim 9,line 24, "predetermined" should be --predeterminable--;
claim 12, line 47, "the" should be --a--. (2nd occur)

Col. 12, claim 14, line 6, "infraredsensitive" should be --infrared-sensitive--;
claim 14, line 10, "supply" should be --supplying--;
claim 17, line 28, change "and receiving assembly including" to --with two emitte
claim 18

Signed and Sealed this

Ninth Day of April, 1991

*Attest:*

HARRY F. MANBECK, JR.

*Attesting Officer*

*Commissioner of Patents and Trademarks*